US006462467B1

(12) United States Patent
Russ

(10) Patent No.: US 6,462,467 B1
(45) Date of Patent: Oct. 8, 2002

(54) METHOD FOR DEPOSITING A RESISTIVE MATERIAL IN A FIELD EMISSION CATHODE

(75) Inventor: Benjamin E. Russ, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/371,807

(22) Filed: Aug. 11, 1999

(51) Int. Cl.[7] ..... H01J 1/62; H01J 9/04

(52) U.S. Cl. ..... 313/495; 313/310; 313/336; 313/351; 445/24; 445/50

(58) Field of Search ..... 313/495, 309, 313/336, 310, 351, 355, 325, 346 R; 445/24, 25, 50, 51; 204/192.38, 298.41, 486, 490, 492; 427/212, 214, 219, 126.1–126.6, 77, 78

(56) References Cited

U.S. PATENT DOCUMENTS

| | | | | | |
|---|---|---|---|---|---|
| 4,663,559 | A | * | 5/1987 | Christensen | 313/336 |
| 5,319,279 | A | | 6/1994 | Watanabe et al. | |
| 5,332,627 | A | | 7/1994 | Watanabe et al. | |
| 5,449,970 | A | * | 9/1995 | Kumar et al. | 313/495 |
| 5,608,283 | A | | 3/1997 | Twichell et al. | |
| 5,747,918 | A | | 5/1998 | Eom et al. | |
| 5,748,069 | A | * | 5/1998 | Dimigen et al. | 338/308 |
| 5,755,944 | A | | 5/1998 | Haven et al. | |
| 5,836,796 | A | * | 11/1998 | Danroc | 445/24 |
| 5,894,188 | A | * | 4/1999 | Chakvorty et al. | 313/309 |

OTHER PUBLICATIONS

Michael J. Shane et al., Electrophoretic Deposition of Phosphors for Display Technology, Mat. Res. Soc. Symp. Proc. vol. 345 1994, pp. 299–304.

Benjamin E. Russ et al., A Study of the Variables Affecting Adhesion Strength of Electrophoretically Deposited Phosphors, J. of the Society for Information Display, 4/3, 1996, pp. 207–211.

Byung–Soo Jeon et al., Electrophoretic Deposition of ZnO:Zn Phosphor for Field Emission Display Applications, J. Electrochem. Soc., vol. 143, No. 12, Dec. 1996, pp. 3923–3926.

Benjamin E. Russ et al., An Analysis of the Binder Formation in Electrophoretic Deposition, J. Electrochem. Soc., vol. 145, No. 4, Apr. 1998, pp. 1253–1256.

Benjamin E. Russ et al., A Study of the Adhesion of Electrophoretically Deposited Phosphors, J. Electrochem-.Soc., vol. 145, No. 4, Apr. 1998, pp. 1245–1252.

Sang Won Kang et al., Photolithographic Patterning of Phosphor Screens by Electrophoretic Deposition for Field Emission Display Application, J. Vac. Sci. Technol. B 16(5), Sep./Oct. 1998, pp. 2891–2893.

Y.W. Jin et al., Performance of Electrophoretic Deposited Low Voltage Phosphors for Full Color Field Display Devices, J. Vac. Sci. Technol. B 17(2), Mar./Apr. 1999, pp. 489–493.

* cited by examiner

*Primary Examiner*—Vip Patel
*Assistant Examiner*—Joseph Williams
(74) *Attorney, Agent, or Firm*—Wood, Herron & Evans, LLP

(57) ABSTRACT

Electrophoretic deposition provides an inexpensive, efficient process for manufacturing a field emission cathode. Particles of a resistive material are deposited by electrophoretic deposition on a conducting layer overlying an insulating layer. An electron emitting layer is then applied over the resistive material to produce the cathode. By controlling the composition of the deposition bath, an electrophoretic deposition process can be used to efficiently produce field emission cathodes that provide a spatially and temporally stable emission field. The deposition bath for the field emission cathode includes an alcohol, a charging salt, water, and a dispersant. The field emission cathodes can be used as an electron source in a field emission display device.

28 Claims, 2 Drawing Sheets

METHOD FOR DEPOSITING A RESISTIVE MATERIAL IN A FIELD EMISSION CATHODE

FIELD OF THE INVENTION

This invention relates generally to field emission display devices, and in particular, to methods of manufacturing cathodes for field emission devices.

BACKGROUND OF THE INVENTION

Field emission displays (FEDs) are flat panel display devices that combine the size and portability advantages of liquid crystal displays (LCDs) with the performance of conventional cathode ray tubes (CRTs). FED devices typically include a field emission cathode positioned opposite a flat screen coated with phosphors. The phosphors emit light in response to bombardment by electrons from the cathode to produce an image. The field emission cathode emits electrons when subjected to an electric field of sufficient strength. The cathode typically includes thousands of microscopic emitter tips for each pixel of the screen. It is principally the emissive nature of the cathode that gives FEDs the thin, flat screen features of an LCD with the viewing angle, brightness, and response speed of a CRT.

While FEDs are potentially very attractive devices, there are two limiting factors in the widespread adoption of the technology. First, FED devices are difficult to manufacture, particularly the FED cathodes. The field emission cathodes typically comprise sharp-tip metal electron emitters having a tip radius on the order a few tens of nanometers, such as molybdenum emitter cones and graphite or diamond emitter cones. A variety of processes have been developed for producing FEDs, but they are complicated and expensive. However, copending application Ser. No. 09/373,028, filed on even date herewith, entitled "Field Emission Cathodes and Process for Their Manufacture", Benjamin E. Russ et al., incorporated by reference herein in its entirety, discloses an inexpensive and improved manufacturing process for field emission cathodes in which the emitting material is deposited by electrophoretic deposition.

The second limiting factor for FEDs is that FEDs are inherently unstable with respect to electron emission. Behaving similarly to a short circuit, when the electron emission begins, it draws all current to an initial emission site, preventing other areas adjacent to the initial emission site from emitting. It has been found that by placing a resistive material, on the order of 300,000 ohm-cm, between the conductive cathode substrate and the emitting material, the emission is more uniform and controlled.

This resistive material is typically vacuum sputtered onto the cathode material, followed by etching. The resistive material is sometimes patterned like the cathode structure and sometimes is left as a uniform coating over all the cathode material. Control of the thickness and uniformity of the resistive material coating is extremely important, but is difficult to achieve with the sputtering process. Moreover, this process can be very expensive using semiconductor manufacturing techniques.

Thus, despite the advances made in the manufacturing of field emission cathodes, there still remains a need for improving the electron emission stability of FEDs. More specifically, there remains a need for an inexpensive, improved technique for forming a resistive material layer where thickness and uniformity may be controlled.

SUMMARY OF THE INVENTION

The present invention provides an efficient and inexpensive method for depositing a resistive material directly onto the cathode portion of a substrate in a field emission display device, with very little waste of the resistive material and with precise control. To this end, and in accordance with the principles of the present invention, particles of a resistive material are deposited on a conducting layer overlying an insulating layer by electrophoretic deposition and an electron emitting material is deposited onto the resistive material layer to produce a cathode. Desired properties of a field emission cathode include requisite adhesive strength of the emitting particles to the resistive material layer and of the resistive material to the conducting layer, sufficient emission when an electric field is applied to the cathode, and spatial and temporal stability of the field emission. These properties may be achieved in the present invention by electrophoretic deposition, in which resistive material particles are suspended in a non-aqueous medium and deposited onto a conducting substrate under the influence of an electric field.

According to a further aspect of the present invention, by controlling the composition of the deposition bath, an electrophoretic deposition process can be used to efficiently and inexpensively produce field emission cathodes of the desired characteristics. The deposition bath for the field emission cathode advantageously includes an alcohol, a charging salt, water, and a dispersant. The dominant component of the deposition bath is a reasonably hydrophilic alcohol such as propanol, butanol, or an octanol. A charging salt such as $Mg(NO_3)_2$, $La(NO_3)_3$, or $Y(NO_3)_3$, at a concentration of between about $10^{-5}$ to $10^{-1}$ moles/liter, is added to the alcohol. The metal nitrates will partially dissociate in the alcohol and the positive dissociation product will adsorb onto the resistive material particles charging them positively. The water content will have a significant effect on the adhesion of particles to the conductive layer and to each other. The dissolved charging salt will react with water to form a hydroxide that will serve as a binder. Water content of between about 1% and about 30% by volume is used to increase the adhesion of deposited particles. The deposition bath also includes a dispersant, for example, glycerin, at a concentration of from 1% to 20% by volume of the deposition bath. Particularly advantageous results may be obtained for deposition of particles of a resistive material in the size range between about 0.01 and 0.5 $\mu$m in a deposition bath of isopropyl alcohol containing $10^{-3}$ molar $Mg(NO_3)_2$ with 3% water by volume and 1% glycerin by volume.

The field emission cathodes produced according to the method of the present invention are expected to exhibit emission with excellent spatial and temporal stability. The resistive layer may be uniformly deposited with good adhesion to the underlying substrate. The field emission cathodes so produced can be used as an electron source in a field emission display device.

These and other objects and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Electrophoretic deposition provides an efficient process for manufacturing a field emission cathode. Particles of a resistive material are deposited on a conducting layer by electrophoretic deposition to produce the cathode. In electrophoretic deposition, particles suspended in a non-aqueous medium are deposited onto a conducting substrate under the influence of an electric field. Desired properties of a field emission cathode which are obtainable by the present invention include requisite adhesion strength of emitting particles to the resistive material layer and of the resistive material to the conducting layer, sufficient emission when an electric field is applied to the cathode, and spatial and temporal stability of the field emission. According to a further aspect of the present invention, by controlling the composition of the deposition bath, an electrophoretic deposition process can be used to efficiently produce field emission cathodes with the desired characteristics.

Figure 1A:
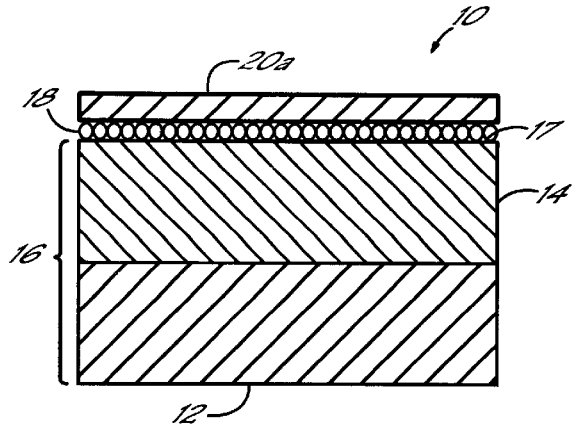
FIG. 1A is a schematic cross section of an embodiment of a field emission cathode according to the principles of the present invention.
Figure 1B:
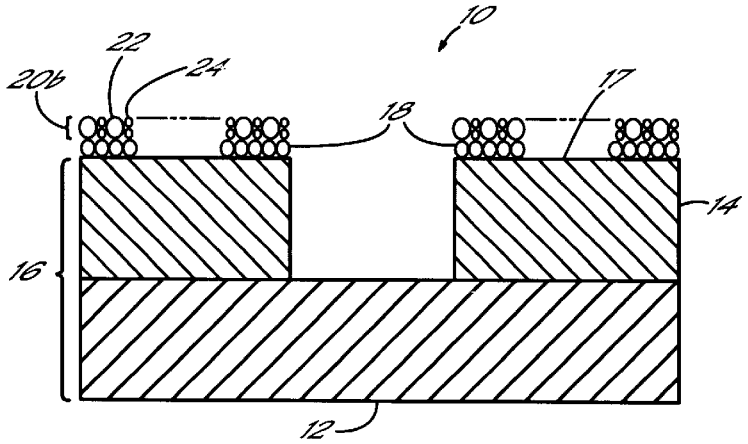
FIG. 1B is a schematic cross section of an embodiment of a field emission cathode according to the principles of the present invention.

FIGS. 1A and 1B are schematic cross sections of field emission cathodes 10 which include conductive material 14 supported on an insulating substrate 12. Substrate 12 and conductive material 14 together constitute cathode support 16. Conductive material 14 can completely cover substrate 12, as in FIG. 1A, or it may form a pattern on substrate 12, as in FIG. 1B. The unsupported surfaces of conductive material 14 form the exposed surface 17 of cathode support 16. Particles 18 of a resistive material are bonded to the exposed surface 17 of cathode support 16 by electrophoretic deposition according to the principles of the present invention. A layer 20 of an electron emitting material is bonded to the layer of particles 18. Layer 20 may be a thin film layer 20*a,* as shown in FIG. 1A, such as that produced by sputtering, or may be a powder coating layer 20*b,* as shown in FIG. 1B. Powder coating layer 20*b* is deposited by electrophoretic deposition and comprises electron emitting particles 22 separated from each other by insulating particles 24 as described in copending application Ser. No. 09/373,028, filed on even date herewith, entitled "Field Emission Cathodes and Process for Their Manufacture", Benjamin E. Russ et al., incorporated by reference herein in its entirety. The presence of insulating particles 24 improves the properties of field emission cathode 10, as described in that copending application.

Substrate 12 of field emission cathode 10 is advantageously made of a rigid insulating material such as glass, ceramic, or plastic. Metals and metal oxides are used for conductive material 14. Particular examples of conductive materials used in conductive material 14 include indium tin oxide (ITO), gold, chromium, aluminum, and chromium oxide. Electron emitting materials that can be used for layer 20*a* or 20*b* in field emission devices advantageously include metals, semiconductors, metal-semiconductor compounds, and forms of carbon such as graphite, diamond, and amorphous carbon. For example, graphite carbon, molybdenum, tin, and silicon, all in powder form, are advantageously used as emitting particles 22 in cathode 10. Additional emitter materials include tungsten, zirconium oxide coated tungsten, n-type doped silicon, porous silicon, metal silicides, nitrides such as gallium nitride, and gallium arsenide on a heavily doped n-type substrate. Beneficial particle sizes for the electron emitting material are between about 0.05 $\mu$m and about 20 $\mu$m. Dispersed, rather than uniform, particle size distributions are preferred to improve packing.

Particles 18 are electrophoretically deposited onto conductive material 14 to form a powder coating layer. The randomly packed morphology of this powder coating 15 layer is distinguishable from the thin film layer deposited by the sputtering technique. By electrophoretic deposition, the resistive particles can be deposited exactly where desired, such as when a pattern is desired, as opposed to sputtering a thin film followed by etching to form the pattern. Thus, a high degree of control is possible with the electrophoretic deposition technique.

The resistive materials comprising particles 18 suitable for use in the present invention are those commonly known materials having a band gap between about 0 eV and about 2 eV, and are available in powder form. Typical materials for use in the resistive material layer of FED cathodes include SiC, Si, $GeO_2$, $SiO_2$, quartz, amorphous silicon, cermets, $CrO_2$, BIROX (bismuth ruthenate in glass) and polymers such as polyamide. The particle size of particles 18 is not critical to the present invention, but smaller particles will tend to produce a more precise morphology in the randomly packed powder layer. Thus, advantageously, the particles 18 have an average particle size in the range of about 0.01 $\mu$m to about 0.5 $\mu$m.

Figure 2:
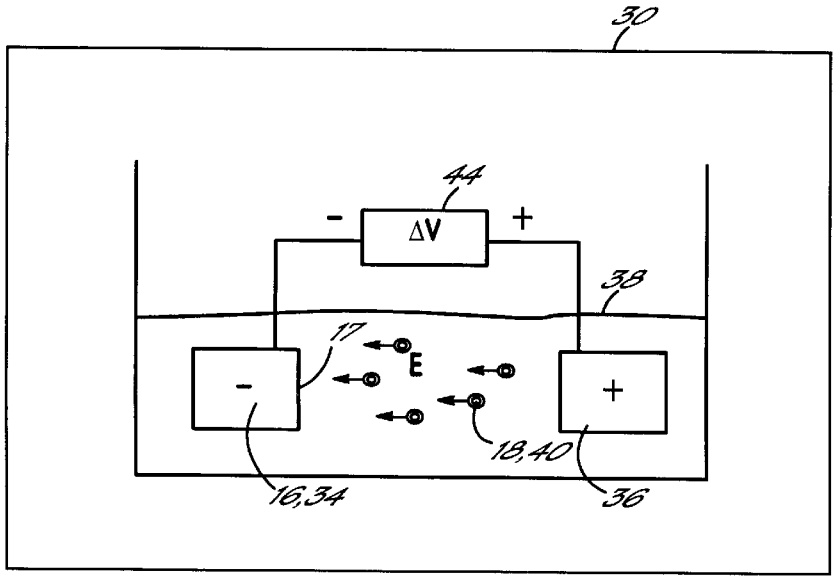
FIG. 2 is a schematic diagram of an electrophoretic deposition cell in which aspects of the present invention are performed.

An electrophoretic deposition cell 30 that may be used to produce field emission cathode 10 is shown generically in FIG. 2. A negative electrode (cathode) 34 and a positive electrode (anode) 36 are suspended in a liquid deposition bath 38, preferably maintained at about 20° C. Positively charged particles 40 are suspended in a liquid deposition bath 38. The method by which the particles are charged is discussed below. Voltage source 44 applies a voltage V, on the order of about 200 V to about 1500 V, that produces an electric field E in the region between the positive electrode 36 and the negative electrode 34. Under the influence of electric field E, positively charged particles 40 will migrate toward the negatively charged electrode 34. To produce field emission cathode 10, charged particles 40 comprise the desired resistive material particles 18, and cathode support 16 of FIG. 1A or 1B is used as the negative electrode 34. Positive cathode 36 preferably comprises a material resistant to electrochemical oxidation, such as platinum meshes and stainless steel. Under the influence of electric field E, the particles 18 will be deposited on the exposed surface 17 of cathode support 16. An electron emitting layer 20 may then be applied over the resistive material to produce field emission cathode 10.

The composition of deposition bath 38 plays a crucial role in the electrophoretic deposition process. According to an aspect of the present invention, deposition bath 22 includes an alcohol, a charging salt, water, and a dispersant. The dominant component of the deposition bath 22 is a reasonably hydrophilic alcohol such as propanol, butanol, or an octanol. Any alcohol that is miscible with water can be used. A charging salt, such as $Mg(NO_3)_2$, is dissolved in the alcohol. One effect of the charging salt is to impart an electrical charge to the resistive material particles 18. The $Mg(NO_3)_2$ will dissociate partially in two steps in the alcohol:

$$Mg(NO_3)_2 \rightarrow Mg(NO_3)^+ + NO_3^-$$

$$Mg(NO_3)^+ \rightarrow Mg^{2+} + NO_3^-$$

The $Mg(NO_3)^+$ ions will adsorb onto the resistive material particles 18, charging them positively. Charging salt concentrations between about $10^{-5}$ and about $10^{-1}$ moles/liter may be used.

The water content of the deposition bath 38 may have significant effect on the adhesion of the deposited resistive material particles 18 to the conductive material 14 and of the particles to each other. When water is present as part of the deposition bath, preferably distilled, deionized water, the dissolved charging salt will react to form a hydroxide that serves as a binder. For example, with $Mg(NO_3)_2$ as the charging salt, the reactions:

$$2H_2O+2e^- \rightarrow H_{2(g)}\uparrow+2OH^-$$

$$Mg(NO_3)^++2OH^-Mg(OH)_2+NO_3^-$$

lead to the formation of magnesium hydroxide. Water content of the deposition bath of between about 1% and about 30% by volume is expected to increase adhesion strength. When water content is too high, evolution of hydrogen gas is expected to interfere with particle deposition on conductive material 14. The charging salt is chosen, therefore, such that the salt of the metal is soluble in the chosen solvent (predominantly alcohol) but the metal hydroxide is insoluble in the chosen solvent. Other examples of charging salts include the nitrates of lanthanum and yttrium.

Finally, the deposition bath also includes a dispersant, such as glycerin, which is also expected to increase adhesion strength. Alternative dispersants include carboxy methyl cellulose, nitro cellulose and ammonium hydroxide. Including a dispersant in the deposition bath is expected to lead to a higher packing density of particles on the patterned conductive material 14. It has been suggested that the hydroxide binder deposits in the interstitial regions between the particles and that adhesion is due to the contact points between particles. By increasing the packing density of the deposit, the number of contact points is increased and thus a higher adhesion strength is achieved. Dispersant concentrations can range from about 1% to about 20% by volume of the deposition bath. The optimal percentages of the different components of the deposition bath depend on the identity of the resistive material and of the individual components. Advantageous results may be obtained for deposition of resistive material particles in the size range between about 0.01 and 0.5 $\mu$m in a deposition bath of isopropyl alcohol containing $10^{-3}$ molar $Mg(NO_3)_2$ with 3% water by volume and 1% glycerin by volume.

The resistive material particles are deposited on cathode support 16 using a parallel plate method of electrophoretic deposition. In parallel plate deposition, a counter electrode, such as positive electrode 36, of the same size and shape as cathode support 16 is positioned parallel to and spaced from exposed surface 17 of cathode support 16. For example, for an ITO patterned 5 cm square glass plate as cathode support 16, a stainless steel positive electrode 36 may be placed at a spacing of approximately 3 cm. The deposition bath as described above is prepared by combining the alcohol, charging salt, water, and dispersant. Resistive material particles 18 are added to the deposition bath. Suitable particle loadings are from about 0.01 to about 10 grams/liter with approximately 3–4 g/l being representative. The particles may be ball milled with glass beads to break up any agglomerates prior to being added to the deposition bath. For example, SiC particles in the size range of about 0.01 to 0.5 $\mu$m may be ball milled with 3 mm glass beads for approximately 4 hours prior to deposition.

The cathode support 16 and counter electrode 36 are placed in the particle-loaded deposition bath, preferably with an electrode spacing of about 2–20 cm, and a DC voltage is applied between conductive material 14 and counter electrode 36 to obtain a current density of from about 0.5 to about 2 mA/cm$^2$. The thickness of the deposit will be proportional to the amount of time the voltage is applied, which will typically range from 1–200 seconds. Time and voltages may vary with the deposition bath composition and cathode pattern. After the voltage is turned off, the cathode is removed from the bath, rinsed with an alcohol, for example, the alcohol component of deposition bath 38, allowed to dry in air and baked at a temperature between about 400° C. and 550° C for from about 10 minutes to about 2 hours to burn off the solvent and to convert the hydroxide from the charging salt reaction to an oxide.

A field emission cathode 10 produced by the electrophoretic method described above is expected to appear uniform on visual inspection. Furthermore, the deposited layer of particles 18 is expected to display reasonable adhesion to the conductive layer 14, and to provide for reasonable adhesion of the emitting layer 20 to the particles. It is expected that the resistive and emitting layers will not be dislodged when a finger is wiped across the surface in a procedure referred to as the "finger-wipe" test. Finally, field emission cathode 10 is expected to exhibit excellent emission characteristics.

Figure 3:
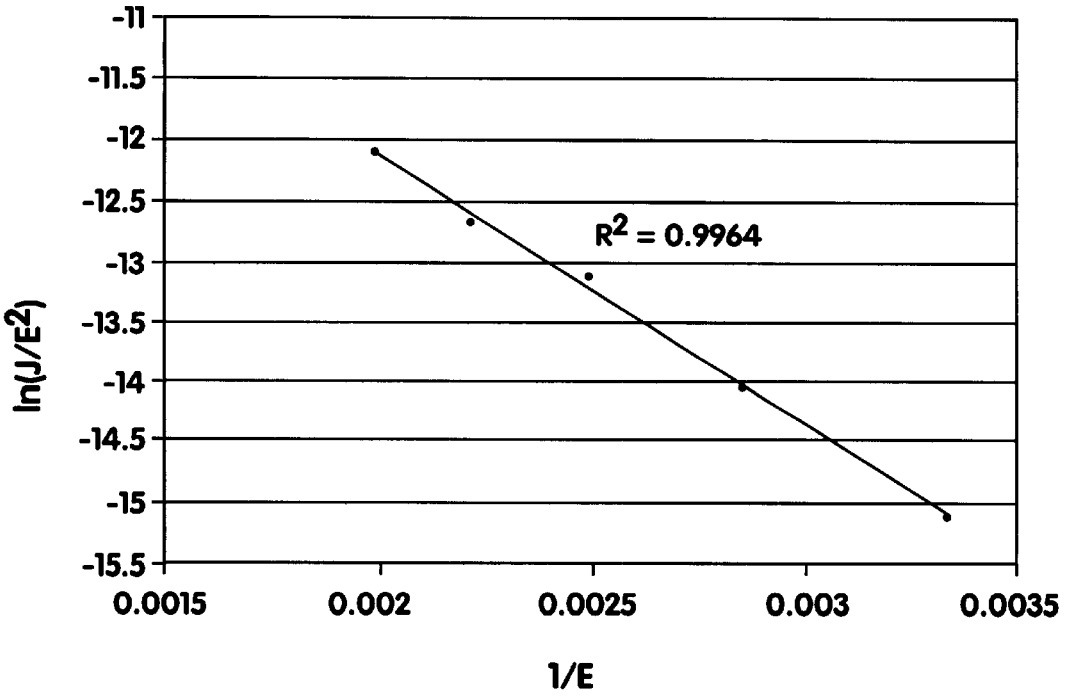
FIG. 3 is a plot of $\ln(J/E^2)$ vs. 1/E where J is the current density and E is the applied electric field for a cathode according to an aspect of the present invention. The points represent the measured values and the straight line is a least squares fit to the data.

The emission field characteristics of field emission cathode 10 may be measured in a second parallel plate configuration. In one example of a measurement configuration, a cathode 10 can be spaced about 150 $\mu$m from a phosphor coated transparent conductor of similar shape, which constitutes a counter electrode, here the node. The cathode 10 and the anode are connected to an appropriate power supply and placed in vacuum of approximately $10^{-5}$ to $10^{-6}$ torr. A positive potential ranging from about 200 to about 1500 V (1.3–10V/$\mu$m) is applied to the anode and the emission current is recorded as a function of applied voltage. The emission current for field emission should follow the Fowler-Nordheim equation:

$$\ln(J/E^2)=a(1/E)+b$$

where J is the current density, E is the applied field and a and b are constants. A hypothetical plot of $\ln(J/E^2)$ vs 1/E in FIG. 3 for a field emission cathode 10 prepared according to the electrophoretic method described above and measured in the second parallel plate configuration is expected to exhibit the linear dependence characteristic of field emission. The phosphors on the anode will allow identification of the field emission sites. Field emission cathode 10, according to the present invention, is expected to evidence sufficient density of emitting sites along the edges of conducting substrate 14 that the emission will appear continuous. Finally, the emission of cathode 10, as measured in the second parallel plate configuration is expected to show temporal stability.

The field emission cathode can be combined with a driving anode and a phosphor coated anode to produce a field emission display. The driving anode is analogous to the gate electrode of conventional field emission cathodes. Using an appropriate pattern of the cathode and gate electrode, desired display characteristics can be achieved. Such a display can easily be scaled to large sizes since the electrophoretic deposition techniques and equipment can be scaled accordingly to provide a uniform electric field on the cathode electrode during deposition of the resistive material. In contrast, technologies dependent on semiconductor processing techniques to fabricate the cathodes do not scale easily.

Field emission cathodes manufactured according to the principles of the present invention are expected to exhibit emission with excellent spatial and temporal stability. The resistive material layer will be a uniform deposit with good adhesion to the underlying substrate. Furthermore, the method of electrophoretic deposition according to the present invention provides an inexpensive, efficient process for manufacturing a field emission cathode with excellent control.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A cathode comprising:

a conductive layer;

a resistive material layer adjacent to the conductive layer, the resistive material layer being a powder coating layer comprising a plurality of particles of a resistive material; and an electron emitting layer adjacent to the resistive material layer, wherein the resistive material layer separates the electron emitting layer from the conductive layer.

2. The cathode of claim 1, wherein the resistive material has a band gap between about 0 eV and about 2 eV.

3. The cathode of claim 1, wherein the resistive material is selected from the group consisting of: silicon carbide, silicon, germanium oxide, silicon dioxide, quartz, amorphous silicon, cermet, chromium oxide, BIROX and polyamide.

4. The cathode of claim 1, wherein the particles of the resistive material have an average particle size of about 0.01 $\mu$m to about 0.5 $\mu$m.

5. The cathode of claim 1, wherein the emitting layer comprises a plurality of particles of an electron emitting material and a plurality of particles of an insulating material wherein the insulating material has a band gap of greater than or equal to about 2 electron volts.

6. The cathode of claim 5, wherein the emitting particles are separated from each other by the insulating particles.

7. The cathode of claim 5, wherein the emitting material is selected from the group consisting of graphite carbon, diamond, amorphous carbon, molybdenum, tin, and silicon.

8. The cathode of claim 5, wherein the insulating material is selected from the group consisting of alumina, silicon carbide, titanium oxide, and zirconium oxide.

9. A field emitting device comprising the cathode of claim 1.

10. A field emitting device comprising the cathode of claim 5.

11. A method of making a field emission cathode, comprising the steps of:

providing a particle loaded deposition bath comprising a plurality of particles of a resistive material, a hydrophilic alcohol, water, a charging salt, and a dispersant;

positioning a cathode support in the loaded deposition bath spaced from a counter electrode, the cathode support comprising a conducting layer on an insulating layer;

applying a voltage between the conducting layer and the counter electrode whereby the particles of resistive material are deposited on the conducting layer; and applying a field emitting layer on the particles of resistive material to produce the cathode, wherein the field emitting layer comprises an electron emitting material and an insulating material.

12. The method of claim 11, wherein the resistive material has a band gap between about 0 eV and about 2 eV.

13. The method of claim 11, wherein the resistive material is selected from the group consisting of: silicon carbide, silicon, germanium oxide, silicon dioxide, quartz, amorphous silicon, cermet, chromium oxide, BIROX and polyamide.

14. The method of claim 11, wherein the particles of the resistive material have an average particle size of about 0.01 $\mu$m to about 0.5 $\mu$m.

15. The method of claim 11, wherein the field emitting layer is applied by electrophoretic deposition.

16. The method of claim 11, wherein the emitting material is selected from the group consisting of graphite carbon, diamond, amorphous carbon, molybdenum, tin, and silicon.

17. The method of claim 11, wherein the insulating material is selected from the group consisting of alumina, silicon carbide, titanium oxide, and zirconium oxide.

18. The method of claim 11, wherein the fraction of water in the deposition bath is from about 1% to about 30% by volume.

19. The method of claim 11, wherein the charging salt is selected from the group consisting of: $Mg(NO_3)_2$, $La(NO_3)_3$, and $Y(NO_3)_3$.

20. The method of claim 11, wherein the charging salt is present in the deposition bath at a concentration of from about $10^{-5}$ to about $10^{-1}$ moles per liter.

21. The method of claim 11, wherein the fraction of dispersant in the deposition bath is between about 1% and 20% by volume.

22. The method of claim 11, wherein the dispersant is glycerin.

23. The method of claim 11, wherein the total weight of particles per liter of deposition bath is between about 0.01 and 10 grams per liter.

24. A cathode comprising:

a conductive layer;

a resistive material layer adjacent to the conductive layer, the resistive material layer being a powder coating layer formed by the process of claim 21; and a field emitting layer comprising an electron emitting material and an insulating material adjacent to the resistive material layer.

25. A cathode comprising:

a conductive layer;

a resistive material layer adjacent to the conductive layer, the resistive material layer being a powder coating layer comprising a plurality of particles of a resistive material; and an electron emitting layer adjacent to the resistive material layer, wherein the resistive material layer separates the electron emitting layer from the conductive layer, the electron emitting layer comprising a plurality of particles or an electron emitting material and a plurality of particles of an insulating material, wherein the emitting particles are separated from each other by the insulating particles, and wherein the insulating material has a band gap of greater than or equal to about 2 electron volts.

26. The cathode of claim 25, wherein the emitting material is selected from the group consisting of graphite carbon, diamond, amorphous carbon, molybdenum, tin, and silicon.

27. The cathode of claim 25, wherein the insulating material is selected from the group consisting of alumina, silicon carbide, titanium oxide, and zirconium oxide.

28. A field emitting device comprising the cathode of claim 25.

* * * * *

UNITED STATES PATENT AND TRADEMARK OFFICE

CERTIFICATE OF CORRECTION

PATENT NO. : 6,462,467 B1
DATED : October 8, 2002
INVENTOR(S) : Russ

It is certified that error appears in the above-identified patent and that said Letters Patent is hereby corrected as shown below:

Column 4,
Line 9, reads "powder coating 15 layer is" and should read -- powder coating layer is --.
Line 23, reads "$CrO_2$," and should read -- $CrO_x$, --.

Column 5,
Line 15, reads "$Mg(NO_3)^+ + 20H^- Mg(OH)_2 + NO_3^-$" and should read -- $Mg(NO_3)^+ + 20H^- \rightarrow Mg(OH)_2 + NO_3^-$ --.

Column 6,
Line 32, reads "here the node." and should read -- here the anode --.

Column 8,
Line 57, reads "by the process of claim 21; and " and should read -- by the process of claim 11; and --.

Column 9,
Line 5, reads "of particles or an electron emitting" and should read -- of particles of an electron emitting --.

Signed and Sealed this

Twenty-sixth Day of October, 2004

JON W. DUDAS
*Director of the United States Patent and Trademark Office*